US005641091A

United States Patent [19]

Daneshvar

[11] Patent Number: 5,641,091

[45] Date of Patent: Jun. 24, 1997

[54] AUTOMATIC PILL DISPENSER II

[76] Inventor: Yousef Daneshvar, 21459 Woodfarm, Northville, Mich. 48167

[21] Appl. No.: 399,912

[22] Filed: Mar. 7, 1995

[51] Int. Cl.[6] ..... G07F 11/00

[52] U.S. Cl. ..... 221/3; 221/82

[58] Field of Search ..... 221/79, 81, 82, 221/123, 186, 187, 188, 189, 266, 3, 6, 9

[56] References Cited

U.S. PATENT DOCUMENTS 4,695,954 9/1987 Rose et al. ..... 221/3

4,838,453 6/1989 Luckstead ..... 221/15

4,870,799 10/1989 Bergerioux et al. ..... 221/2

5,221,024 6/1993 Campbell ..... 221/3

*Primary Examiner*—Kenneth Noland

[57] ABSTRACT

The use of medication is common and many times is small but potent and should be taken on a timely basis. However, some people have a tendency to forget this and this creates medical and psychological problems. This unit is designed to prevent such occurrences. This unit is a machine that will allow a person to receive his or her medication on a timely basis. The machine will hold the medication in a series of small spaces and will rotate to allow the proper dose to be picked up via a fixed window.

20 Claims, 8 Drawing Sheets

AUTOMATIC PILL DISPENSER II

Please notice that since some of the ideas of this invention were previously introduced to the patent office by this applicant, he therefore wishes to ask this application to be a continuation in part of his previously introduced applications, and the content of the following applications are incorporated by reference as if they were fully disclosed herein.

1. The patent for the Automatic Pill dispenser was granted on Dec. 13, 1994 with the U.S. Pat. No. 5,372,276
2. The application for Pill Sample Illustrator was applied on Jun. 10, 1994 with the Ser. No. 08,258,269

THE BACKGROUND OF THIS INVENTION

The use of medication is common and what is also common is forgetting to take it on a timely basis. Therefore, this applicant has introduced his unit, the Automatic pill dispenser, and in this application he wishes to introduce another model which is a somewhat simpler unit.

THE BRIEF EXPLANATION OF THE INVENTION

This application introduces a unit that will allow a person to receive his or her medication on a timely basis. This unit consists of a round piece that rotates around a center and has a series of small pill spaces that it will hold a dose of patients medications or its representative and will allow them to be removed on timely basis.

This unit also has a piece called the Pill Sample illustrator that is attached to this unit and will allow the unit to show the samples of the pills and also to illustrate their names, natures and dosages.

THE FIGURES

THE BRIEF EXPLANATION OF THE FIGURES

Please notice that the reason different figures are shown is that the applicant has tried to illustrate some important parts or options in each individual view. Many of these options are to be included in one model. The applicant also recognizes that these figures are informal and apologizes to the examiner for this matter; however, he will provide the proper figures later when the application has appeared to be allowable.

Figure 1:
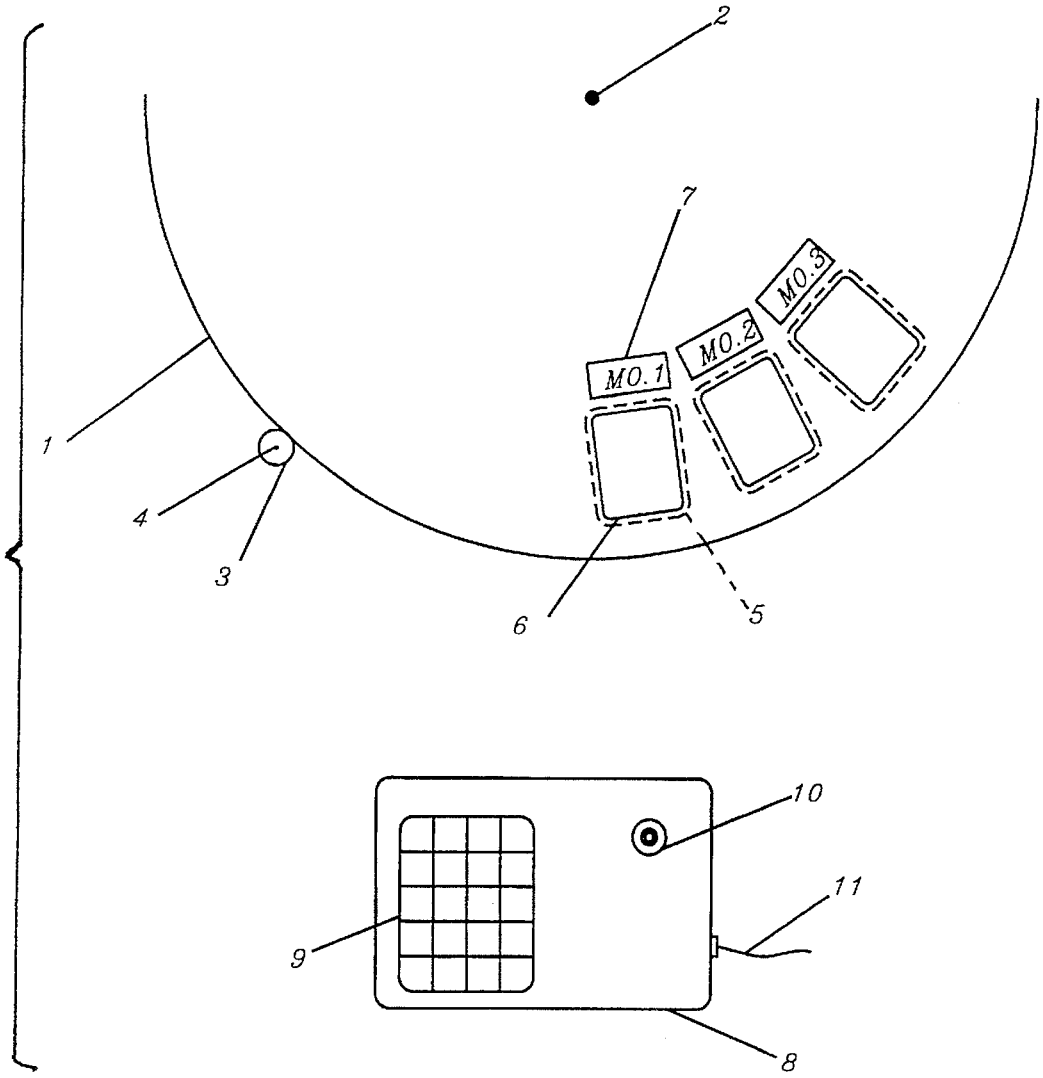

FIG. 1. Shows a round unit with small pill spaces that will rotate to allow one dose of medication to be removed.

Figure 2:
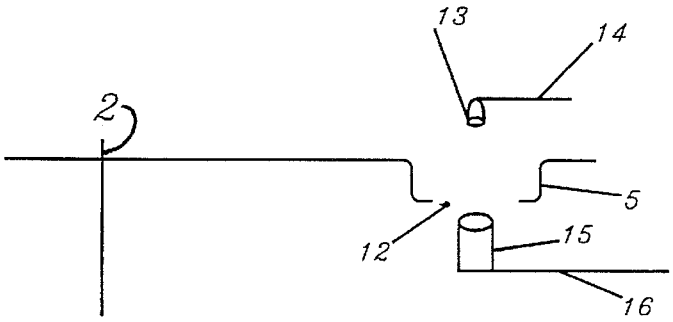

FIG. 2. Shows a photocell unit that will allow a supervisor to notice if the pills were not taken.

Figure 3:
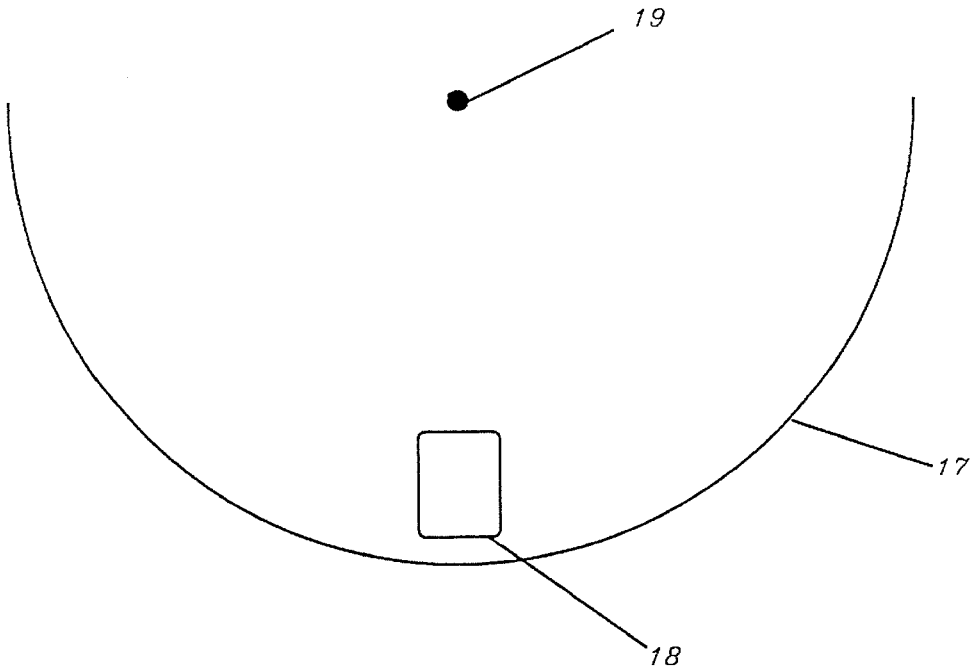

FIG. 3. Shows the top and from portion of a round cover that will go over this unit.

Figure 4:
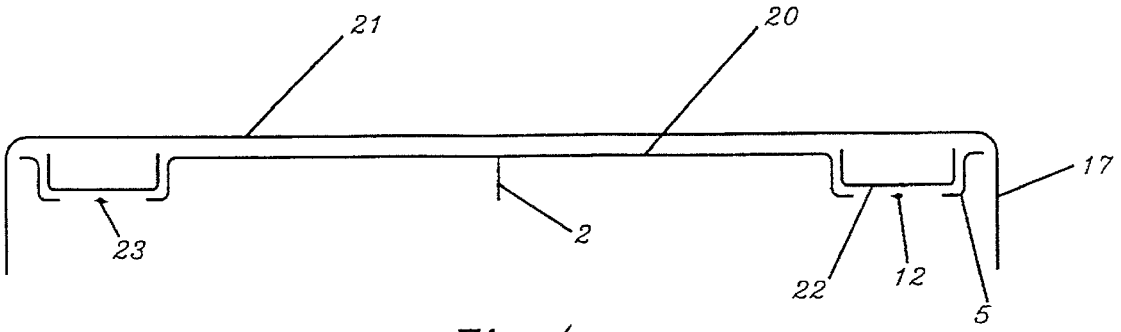

FIG. 4. Shows the cross-cut view of the cover piece 21 standing over the rotating part 20 of this unit.

Figure 5:
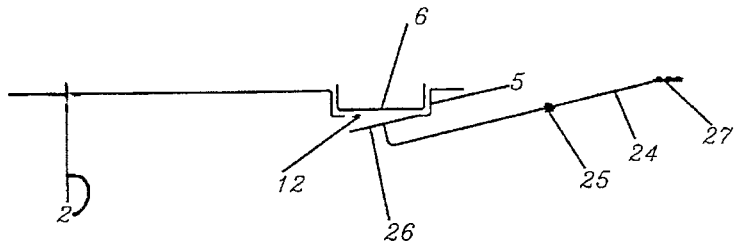

FIG. 5. Shows a lever system that is to lift the small pill space.

Figure 6:
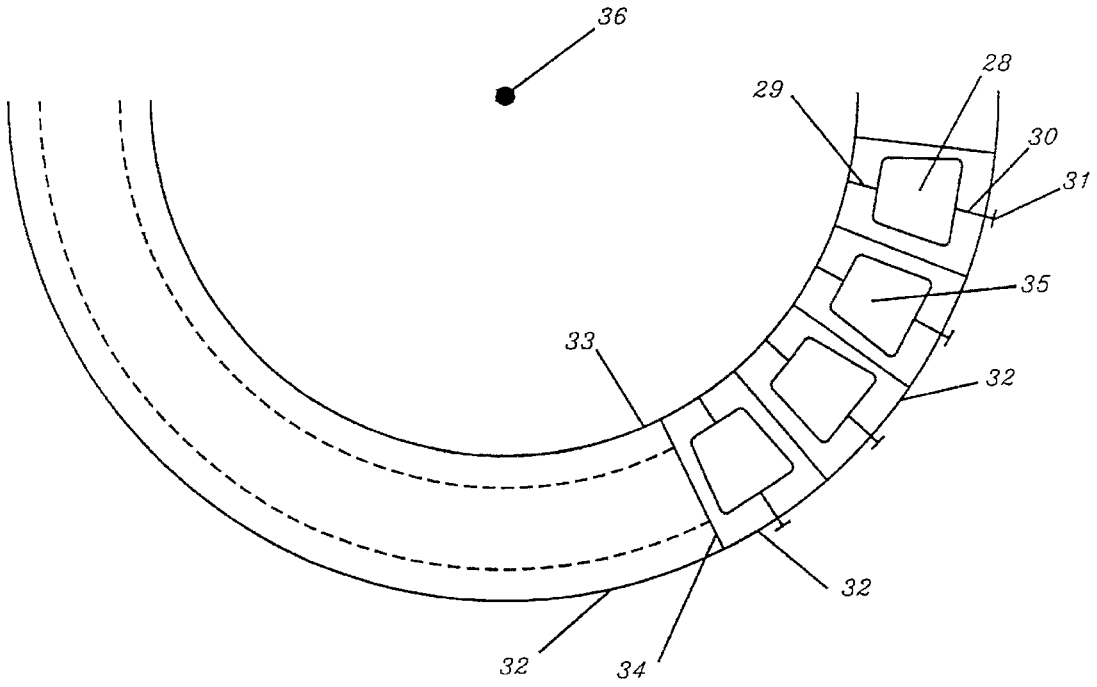

FIG. 6. Shows a top view of a series of small pill spaces that can rotate around an axis.

Figure 7:
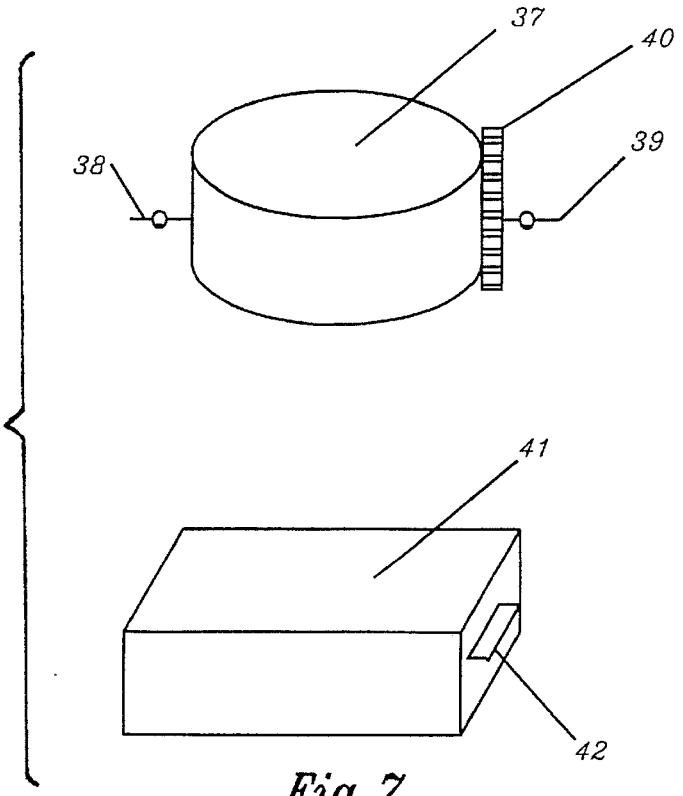

FIG. 7. Shows the side view of a small pill space that will be rotated to drop medication inside a lower space.

Figure 8:
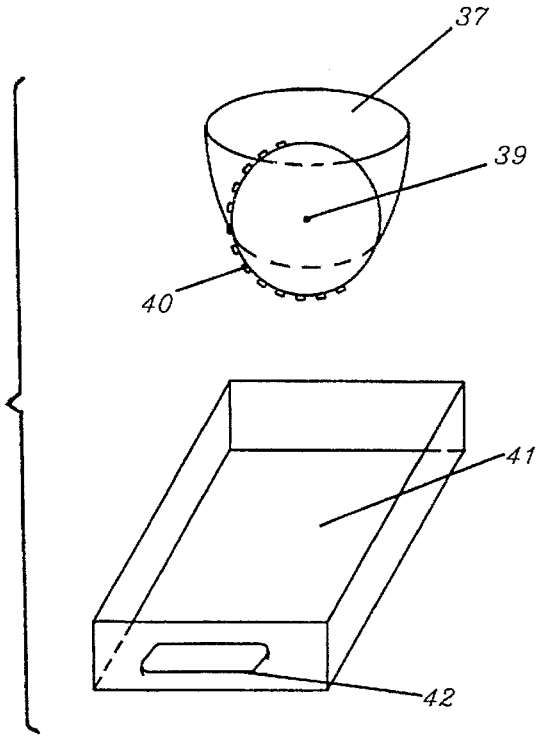

FIG. 8. Shows the front view of the small pill space 37 which was shown at previous FIG. 7.

Figure 9:
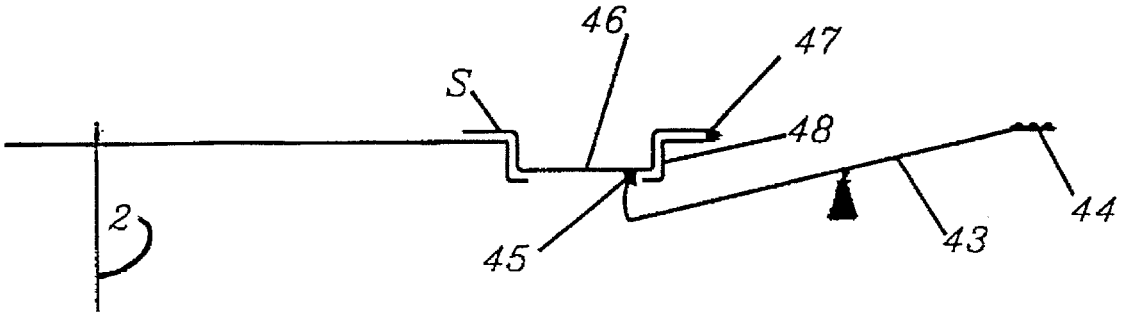

FIG. 9. Shows a small pill space which has a hinge on the side and a lever system as well.

Figure 10:
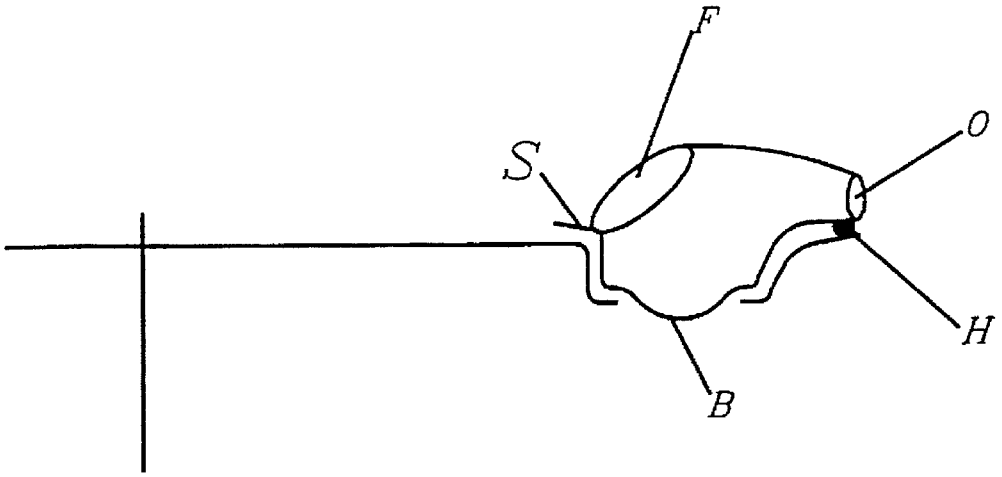

FIG. 10. Shows a model with hinge and funnel.

Figure 11:
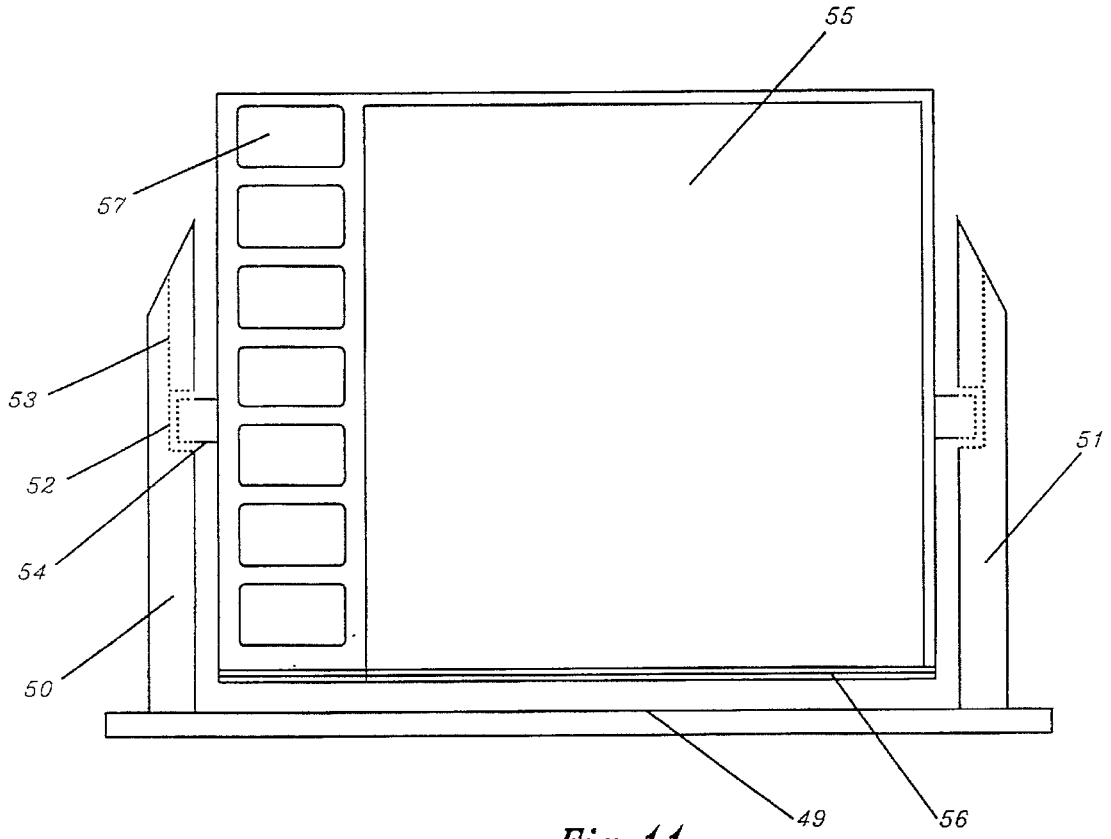

FIG. 11. Shows a pill sample illustrator that will be attached to the cover of this unit.

Figure 12:
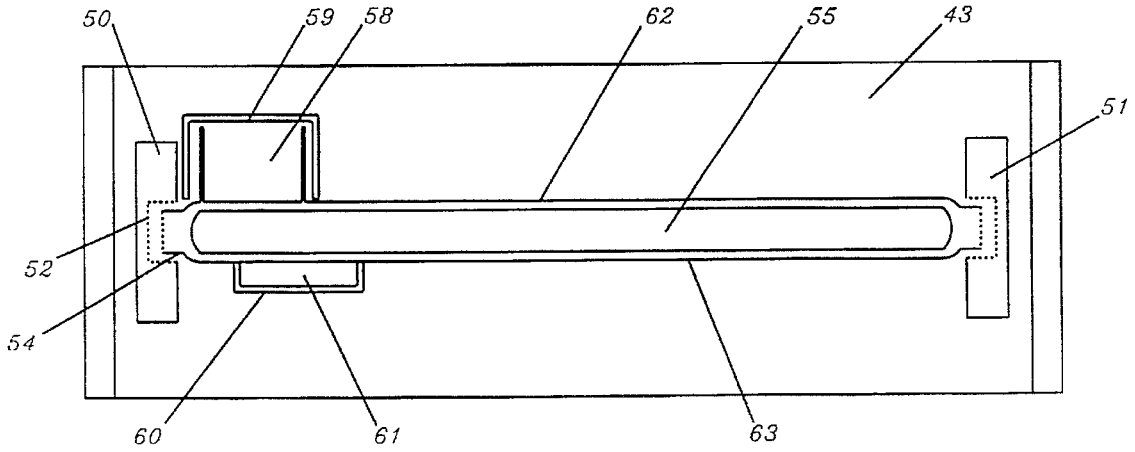

FIG. 12. Shows the top view of the pill sample illustrator similar to the one shown in previous FIG. 11.

Figure 13:
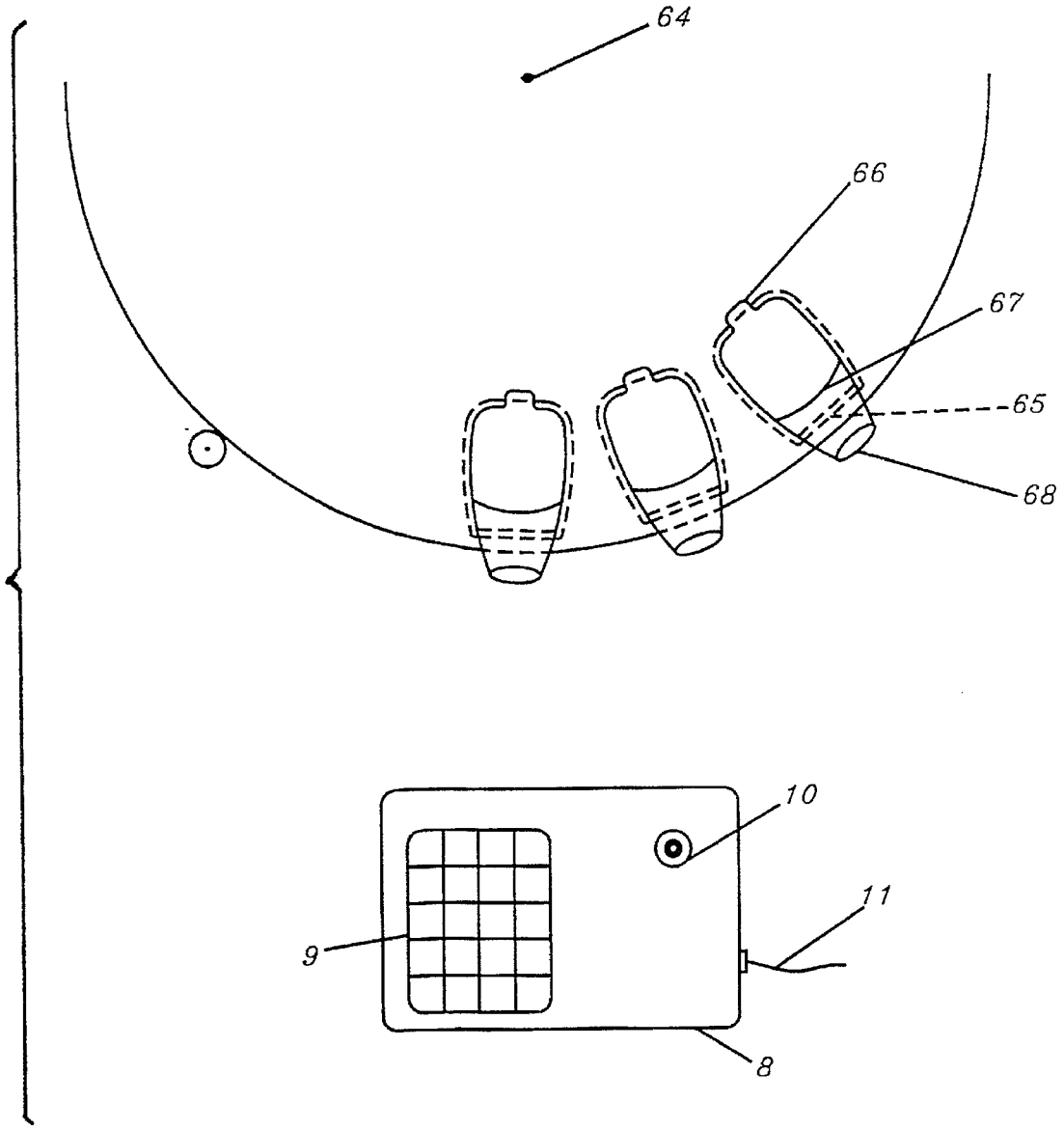

FIG. 13. Shows a unit whose small pill space has a hinge and funnel.

Figure 14:
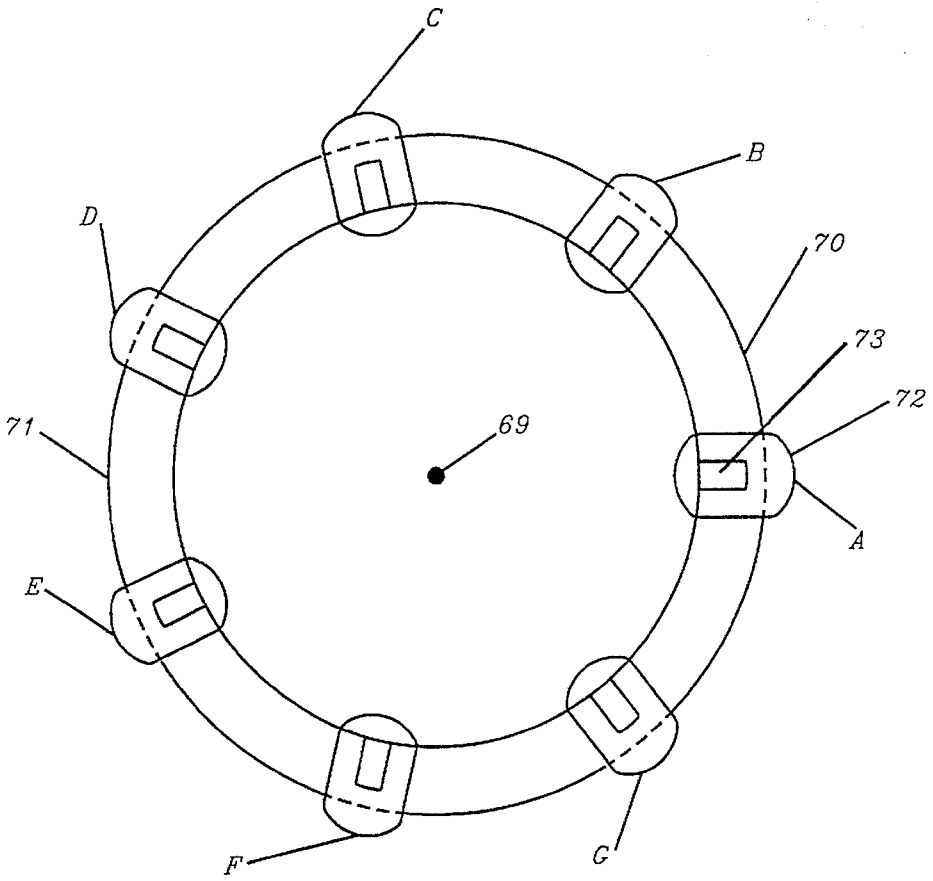

FIG. 14. Shows a unit for the placement of pills into the small pill spaces.

Figure 15:
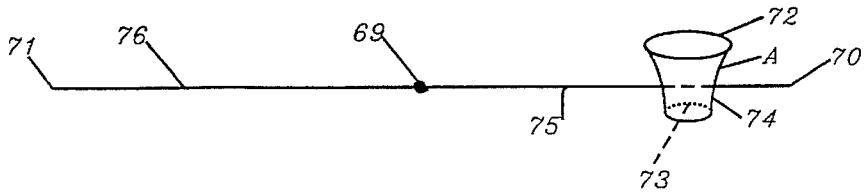

FIG. 15. Shows the schematic side view of a funnel A and the body of the unit shown at FIG. 14.

THE DETAILED EXPLANATION OF THE FIGURES

FIG. 1. This figure shows a round unit 1 which will rotate around its center 2. This round unit has a series of small pill spaces, such as the one shown in 6, that will be properly sized to hold one dosage of an average patient's medication. This unit can be turned by many ways, such as the rotation of the center pole or by having a wheel that will rotate by an engine and cause this unit to rotate, etc. One such wheel is shown at 3 and rotates around its own center 4. This small pill space will be placed inside a cradle 5 that has an opening in the bottom shown at FIG. 2 no 12. The unit will be colored and will have other signs to give information about the day and time for medication. One such piece (shown at 7) will have a background coloring and shows the abbreviation of the day "MON the first, second or third dose of medication." The coloring of these areas will be different for the morning, noon, afternoon and evening doses. This figure also shows a computer 8 that will allow programming to be done via different command buttons, one shown at 9. This computer has an announcer shown at 10 that will broadcast the programed information; the unit also can be connected to the telephone line by wire 11. Importantly the base of the small pill spaces may be made deeper in order to hold even the last medication inside. Also importantly the small pill space may be hinged to the side of the cradle or the wall of the rotating piece in order to allow an easy system for emptying these small pieces.

The size of the base, shape, thickness, length, width, depth, curvature, color, consistency and other important characteristics of these spaces and units may change.

FIG. 2. This figure schematically shows how a photocell unit may be used to allow a supervisor to notice if the pills were not removed from the unit. This shows the cross-cut view of the cradle 5 for one small pill space similar to the one shown in the previous FIG. 1. Except in this figure the small pill space has been removed, so that the open center 12 of the cradle 5 can be seen. In this figure the light 13 has the electrical wire 14 connected to a circuit that ends with the photocell 15. The photocell is connected to the circuit via the wire 16. In ordinary conditions, when the light can go through the open space 12, there will be no reaction from the system. However, if the small pill space was not removed, it will block the passage of the light and this will make the unit react and start a series of actions to allow the patient or supervisor to note the problem. Importantly, in models in which the small pill space will not be removed, the following mechanism will be used to allow the light to go through for identification. First of all, the pill space will be made clear. Second, the bottom of the pill space will be made lowest (such as "B," FIG. 10) in the center to hold even the last pill that is not removed; this lone pill will prevent the light from going through and will activate the alarm. Third, a magnified lens may be used to allow the light beam to be used more effectively. This unit may be placed next to the pill removal area so that it will activate as soon as the non-removal of the pill is recognized. Importantly, please notice that the period in which the photocell will function will be chosen and planned by the computer so that the motion of the other parts and their blockage would not cause problems in its function. Also a notch or lever may be used in order to activate the photocell on or off in proper time.

FIG. 3. This figure schematically shows only the front portion of a round cover unit that will be positioned to stand on the unit, shown at FIG. 1. This is a solid cover that will go around the sides of the unit shown at FIG. 4. It's only opening is shown at 18. This opening, which matches the size of the small pill space 6, will allow it to be removed from the cradle 5 easily when it is rotated underneath the opening 18. Importantly, this cover may be made clear to allow the unused medication to be seen. The sides of this cover in the front will have informative designs, markings and coloring in order to indicate the type of the information that the user should know. The side will also be clear or at least will have a clear band that will allow the color of the pill spaces and its cradles to be seen for identification of the day and dosage of the medication that they represent. The opening of this cover may be on the side or the top, as well as the side and the site. The size, shape and other important parts of this opening and cover may vary.

FIG. 4. This figure schematically shows the cross-cut view of the cover piece 21 standing over the rotating part 20 of this unit. In this figure the center point which the unit rotates around is shown at 2. The two small pill spaces are shown one on each side. The side of the cover is shown at 17. In the right side of the figure, the space for the small pill space is marked at 5 and has an opening in its center marked at 12. The pill space is marked at 22 and the opening space of the other cradle in the left is shown at 23.

FIG. 5. This figure is to schematically show one of the methods that allows the pill spaces to be removed from this unit easily. In this model a simple lever system is used to lift the small pill space. In this figure the center of the unit is shown again at 2 and the removeable small pill space is shown at 6. The place that holds this piece 5 has an opening in its base, shown at 12, which will allow the lever system of 27, 25 and 26 to raise the small pill space. This lever system has a flat area 26 which may be made to tilt a little; the base 26 will tilt around the pole 25 so that the pressure in the tip of the handle 27 will raise the tip 26 and thus raise the small pill space 6 for easy removal of this piece and the pills. The size, shape, thickness, length, width, depth, curvature, color, consistency and other important characteristics of this lever system and its related parts may vary.

Importantly, this piece may be made to empty its contents into another adjacent container (not shown here) for an easier removal. In this case, one side of the small pill space will be hinged and the base or side may be lifted in order to move it up and rotate along the hinge to dump its contents. Such a hinge may be placed on either side of the small pill space. The small space then will be moved back to its initial position. One sample of this method is shown at FIG. 9.

FIG. 6. This figure schematically shows the top view of a series of small pill spaces such as the one shown at 28 that are designed to rotate along an axis 29–30 so that rotation of a piece, such as the one shown at 31, will allow the contents of the pill space to be dumped onto the lower space. This unit 32 also rotates along the center 36, has the inner border 33 and short walls such as 34 between the inner border 33 and the outer border 32. This is similar to the top unit shown in the applicant's previous invention: Automatic Pill Dispenser.

FIG. 7. This figure schematically shows the side view of a small pill space 37 which is similar to the one shown at 28 from the previous FIG. 6. In this figure the space 37 will rotate along the axle 38 and 39 and has the wheel 40 that will allow the unit to be rotated for dumping its contents into the space 41. The space 41 has a handle 42 that will allow it to be pulled out from its place for removal of the pills.

FIG. 8. This figure schematically shows the front view of the small pill space 37 which was shown at the previous FIG. 7. In this figure, the axle 39 is shown as well as the wheel 40. This figure shows that the wheel 40 may have only partial or irregular indentation and its rotation will rotate the space 37. With the rotation of the space 37, the pills will dump into the container 41; the handle of the space 41 is shown at 42.

FIG. 9. This figure schematically shows how a small pill space 46 such as the one shown in the previous FIG. 5 may have a hinge on the sides, (like the one shown at 47) to allow a lever system 43, 44 and 45 to be used to tilt the small pill space around the hinge 47 and dump the contents into a space held in its border. In this figure the center of the unit is shown again at 2 and the small pill space is shown at 46. The place that holds this piece 48 has the opening in its base which will allow the lever system of 43, 44 and 45 to raise the free end of the small pill space 46. This will cause it to be rotated to dump its contents into a container not shown in this figure. In these models the small space may have a small handle, shown at "S," that will allow the user to lift the small pill space with significant ease and make this process easier. The sides of the piece 46 in the hinge side may be raised and curved so that it will function like a funnel and direct the pills to drop inside an adjacent space smoothly without dispersing it around without method.

FIG. 10. This figure is a schematic figure to illustrate a couple of important points: first, to show how a simple method may be used to dump the medication from the small pill space. This model is similar to the one shown in the previous FIG. 9. Except in this figure the lever system is eliminated and instead the small pill space is hinged to the outer border of the moving round central piece at H. It also has the small snap S that will allow the small pill space to be held and tilted out to dump the medication into an adjacent space that is designed to receive the medication. This figure also shows a lower bottom surface shown at B that is designed to hold the last pill. This pill space also has curved walls that have made the funnel F which has the opening O and will allow the pills to be comfortably dumped into another hand-held unit. In these models the opening of the cover will be modified to allow such a movement to occur.

FIG. 11. This figure shows a front view of a pill sample illustrator. This figure show how this unit has a base 49 that will be connected to the cover of the unit and will hold poles 50 & 51. The body of this unit has a space 55 for the placement of an information sheet and a cap or door at 56 that is to prevent the information sheet from falling down when the unit is turned upside down. The pill column is shown on the left side of this unit and has a series of small pill places, such as one shown at 57 which are for the placement of one particular pill, capsule or medication representative. The small pole 54 will slide through the opening 53 from the pole of the unit in order to fit into the place 52. This will allow the unit to be turned around.

FIG. 12. This figure shows the top view of a pill sample illustrator similar to the one shown in the previous FIG. 11. In this view, the base of this unit is marked at 49, and the poles 50 & 51 are shown. The opening of the left pole, marked at 52, is holding the small pole 54 from the body of the unit. The large flat slot for the placement of the information sheet is marked at 55. Its front wall is at 63 and the rear wall at 62. The body of this unit has a space 55 for the placement of the information sheet and a cap or piece at 49 which will prevent the information sheet from falling down when the unit is turned upside down. The column of pills is shown in the left side of the unit and one of the small pill spaces is shown at 58. One cross-cut view of a small pill space is shown at 58 and is covered by a cover 59 that will prevent the pills from falling out. The space for greetings is marked at 61 and has a front wall 60. A picture of choice will also be inserted to be placed in the rear side of the information sheet so that after rotation the picture can be visualized. And a greeting such as "I love you Mom" may be placed in the space 61 to be seen when the picture side is turned to be seen. The details of this unit are shown in the previous application of the Pill Sample Illustrator. The sheet of information will include important information about the pills, such as the name, main function, dosage and frequency that it needs to be taken. This piece will have lines to allow an easy association of the pills with the information. In some cases, such as with insulin or powder, etc., when the medication cannot be placed in these small spaces, the representatives of the medications will be used. Importantly the poles of this unit may be made to have hinges in order to allow the unit to be placed flat on the cover of the main unit to occupy less space during packaging or transfer of the unit from one place to another.

FIG. 13. This figure shows a unit that is similar to the model shown in the previous FIG. 1 except this unit has the hinge that will allow the unit to be tilted for emptying its content. It also shows a funnel system that will allow the process of dumping to be done more easily. Also the small handle 66 will allow the removal to be easier. In this figure the center of the rotation is shown at 64, the hinge is marked at 65, and the rim of the funnel type system is shown at 67. The opening is shown at 68. Please notice that the location of the hinge 65 and the size of the other parts will be designed so that it will allow the person to lift this unit by holding the tip 66 and rotating it outwardly in this model to allow the pills to drop into a space via the funnel shown at 67–68.

FIG. 14. This figure shows a pill dispensing unit that was previously introduced in the application of "Automatic Pill Dispenser". This unit consists of a series of funnels that are properly shaped, sized and located so that this unit can be placed over the small pill spaces in order to allow the pills to be dispensed easily and properly in those spaces. This will allow the person to put this unit on the pill spaces for the mornings and drop the pills into the spaces one after another, then to put in the pill spaces for noon and drop the pills in those spaces, etc. The location of the center of this unit 69 will match the center 2 FIG. 1 of the flat unit that holds the small pill spaces. In this figure the seven funnels are shown at A, B, C, D . . . till F. Importantly the number of these funnels may change and can be made with different numbers of funnels or a simple method can be chosen so that the number and distance of these funnels from each other can be changed and adjusted. The outer rim of the body of this piece is shown at 70 & 71, one large opening of a funnel is shown at 72 and its lower opening at 73.

FIG. 15. This figure shows the schematic side view of the funnel A and the body of the unit shown in the FIG. 14. In this figure the center of this piece is at 69, its right side at 75 and left side at 76. The right border is at 70 and the left at 71. One large opening of the funnel A is shown at 72, its lower opening at 73 and the lower end of it at 74.

THE DETAILED EXPLANATION OF THIS INVENTION

This application introduces a pill dispenser unit that is designed to allow a collection of medication to be provided to a patient on a timely basis. This model uses the basic idea of providing medication on a unit that rotates and is similar to the upper rotating piece of this applicant's previous invention: "The Automatic pill dispenser." However, this unit has a series of spaces that allows a particular medication to be removed. In this model (as shown in FIG. 1) the unit has a series of small spaces placed around a circular horizontal piece and these spaces will be properly-sized to hold a reasonable dose of medication, consisting of pills and capsules or the representative of a medication that is not in pill or capsule form (such as insulin, skin patches, syrups or powders). This piece may have different numbers of small spaces or may be made to be adjustable and having different small spaces placed on it. The prototype will consist of 28 equally sized pill spaces that are radially positioned around a circumference of a circular body 1. This space will then rotate around the center 2 by the use of an electrical engine. This engine will be controlled by a computer, as shown at 8, so that the programming of the computer will allow the speed, timing, stopping period and all other important factors and parameters of the rotation of this unit to be programed, chosen, adjusted, changed and controlled. This circular unit will have a rigid cover shown at 17 FIG. 3 and 17–21 FIG. 4 that will stand over this unit and will protect it from the outside. However, this cover will have at least one opening 18 on its top surface that is designed to allow the medication to be removed from the small pill space, which will rotate under it. In some models, these small pill spaces will be made rotational in one direction or another, to allow the pills to be dropped if the pill space was rotated one way or another. This was shown in the applicant's previous invention: "The Automatic Pill Dispenser." and is also shown at FIG. 6–8. In the model shown at FIG. 1, the pills will be placed in small spaces (such as the one shown at 6) that will be placed inside a matching space or a cradle (such as one shown at 5). This unit will have a cover shown at FIG. 3 that has an opening 18. The rotation of piece 1 will make the small pill space stand underneath the opening 18 and be able to be picked up The rotation of the circular piece may be controlled by different means: mechanical or computer control. This unit may be designed to allow simple methods such as a lever system or a similar method to be used to allow the pills to be removed. One such example is shown at FIG. 5. In this figure the center of the unit is shown at 2 and the removeable small pill space is shown at 6. The place that holds this piece 5 has an opening in its base shown at 12 which will allow the lever system of 27, 25 and 26 to raise the small pill space. This lever system has a flat area 26 which may be made to tilt a little; the base 26 will move around the pole 25 so that the pressure in the tip of the handle 27 will raise the tip 26 and thus raise the small pill space 6 for easy removal of this piece and the pills. Importantly, this piece may be made to empty its contents into another adjacent container (not shown here) for an easy removal. In this case one side of the small pill space will be hinged (no 47 FIG. 9 and H FIG. 10) and the base or side may be lifted in order to rotate it along the hinge to dump its contents. Such a hinge may be designed to be placed on either side of the small pill space. The small space then will be moved back to its initial position, although in some models it may be left out or in the side in order to allow the observation to be made that the pills are removed or allow the light to go through the open part of the base for the activation of the photocell. The opening space under the pill space is shown at FIG. 9 and 10.

Another method will use a unit which is very much similar to the one shown in the previous application of "Automatic Pill Dispenser". Such a model is shown at FIG. 6. In this model, a series of small pill spaces such as the one shown at 28 are placed around the piece that rotates. This small pill space 28 rotates along an axis 29–30 so that the rotation of a piece such as the one shown at 31 will allow the contents of the pill space to be dumped into the lower space. This circular piece 32 rotates along the center 36, has an inner border 33 and short walls such as 34 between the inner border 33 and the outer border 32. FIG. 7 shows schematically the side view of a small pill space 37 which is similar to one shown at 28 from the previous FIG. 6. In this figure the space 37 will rotate along the axle 38 and 39 and has the wheel 40 that will allow the unit to be rotated for dumping its contents into the space 41. The space 41 has a handle 42 that will allow it to be pulled out for removal of the pills. FIG. 8 shows schematically the front view of the small pill space 37 which was shown at the previous FIG. 7. In this figure, the axle 39 is shown as well as the wheel 40. This figure shows that the wheel 40 may have only partial or irregular indentation and its rotation will rotate the space 37. With the rotation of the space 37 the pills will dump into the container 41; the handle of the space 41 is shown at 42. Please notice that in this case the cover of the unit may not need to have a full opening to allow the pills to be picked up from the top; however, it will have a lever system to be used to rotate the wheel 40 or a simple opening in a proper area in order to allow the wheel 40 to be rotated.

FIG. 9. This figure schematically shows how a small pill space 46 such as the one shown in the previous FIG. 5 may have a hinge in the side such as one shown at 47 to allow a lever system made of 43, 44 and 45 to be used to tilt the small pill space around the hinge 47 and dump the contents to a space held in its side. In this figure the center of the unit is shown at 2 and the small pill space at 46. The place that holds this piece 48 has the opening in its base which will allow the lever system of 43, 44 and 45 to raise the free end "S" of the small pill space 46. This will cause it to be rotated to dump its contents into a container or a receiving piece that is not shown here. The user may lift the handle "S" in order to facilitate the process of emptying. The sides of the piece 46 in the hinge side may be raised and curved to act like a funnel and direct the pills to drop inside an adjacent space smoothly without spreading around without direction. FIG. 10 shows a simpler method that may be used to dump the medication out of the small pill space. This model is similar to the one shown in the previous FIG. 9. Except in this figure the lever system is eliminated and instead the small pill space is hinged to the outer border of the moving round central piece at H. It also has the small snap S that will allow the small pill space to be held and tilted out to dump the medication into an adjacent space that is designed to receive the medication. This figure also shows a lower bottom surface shown at B that is designed to hold the last pill. This pill space also has curved walls that have made the funnel F which has the opening O and will allow the pills to be comfortably dumped into another hand-held unit. In these models the opening of the cover will be modified to allow such a movement to occur.

FIG. 11. This shows a pill sample illustrator that can be attached to the body of this unit to fortify its usefulness. This figure shows such a unit which has a base 49 that will be connected to the cover of the automatic pill dispenser and will hold the poles 50 & 51. The body of this unit has a space 55 for the placement of an information sheet and a cap or door at 56 that is to prevent the information sheet from falling down when the unit is turned upside down. The pill column is shown on the left side of this unit and has a series of small pill places; one is shown at 57 and is for the placement of one particular pill, capsule or medication representative. The small pole 54 will slide through the opening 53 from the pole of the unit in order to fit in place 52 and this mechanism will allow the unit to be turned around.

FIG. 12. Shows the top view of the pill sample illustrator similar to the one shown in previous FIG. 11. In this view, the base of this unit is marked at 49 and the poles 50 & 51 are shown with the opening of the left pole marked at 52, which is holding the small pole 54 from the body of the unit. The large flat slot for the placement of the information sheet is marked at 55. Its clear front wall is at 63 and the clear rear wall at 62. The body of this unit has a space 55 for the placement of the information sheet and a cap or piece at 49 which prevents the information sheet from falling down when the unit is turned upside down. The column of pills is shown in the left side of the unit and one of the small pill spaces is shown at 58. One cross-cut view of a small pill space is shown at 58 and is covered by a clear cover 59 that will prevent the pill from falling out. The space for greetings is marked at 61 and has a clear front wall of 60. A picture of choice will be inserted in the rear side of the information sheet so that after rotation the picture can be visualized. And a greeting such as "I love you Mom" may be placed in the space 61 to be seen when the picture side is visualized. The details of this unit are shown in the previous application of "Pill Sample Illustrator". The sheet of information which goes into the space 55 will include important information about the pills such as the name, main effect, dosage and frequency that it needs to be taken. This piece will have lines to allow easy association of the pills with their information. In some cases, injected medication such as insulin, skin patches, syrups or powders, etc., that are not ingested cannot be placed in these small spaces and representatives of these must be used.

FIG. 13 shows a unit that is similar to the model shown in the previous FIG. 1 except this unit has a hinge that will allow the unit to be tilted for emptying its content. It also shows a funnel system that will allow the process of dumping to be done more easily. Also a small handle 66 will allow the removal to be easier. In this figure the center of the rotation is shown at 64, the hinge is marked at 65, and the rim of the funnel type system is shown at 67. The opening is shown at 68. Please notice that the location of the hinge 65 and the size of the other parts will be designed so that it will allow the person to lift this unit easily by holding the tip 66 and rotating it outwardly in this model to allow the pills to drop into a space via the funnel shown at 67–68.

FIG. 14. Shows a pill dispensing unit that was previously introduced in the application of Page 18 "Automatic Pill Dispenser". This unit consists of a series of funnels that are properly shaped, sized and located so that this unit can be placed over the small pill spaces in order to allow the pills to be dispensed easily and properly in those spaces. This will allow the person to put this unit on the pill spaces for the mornings and drop the pills into the spaces one after another, then to put in the pill spaces for noon and drop the pills in those spaces, etc. The location of the center of this unit 69 will match the center of the flat unit that holds the small pill spaces. In this figure the seven funnels are shown at A, B, C, D . . . till F. Importantly the number of these funnels may change and can be made with different numbers of funnels. The outer rim of the body of this piece is shown at 70 & 71, one large opening of a funnel is shown at 72 and its lower opening at 73. FIG. 15. Shows the schematic side view of the funnel A and the body of the unit shown in the FIG. 14.

The methods of emptying the small pill space:

The purpose of this section is to show how these suggested methods may be used with these units in order to allow the pills to be removed from the small pill space:

a. The small pill space may be simply picked up from its space. This is shown in FIG. 1, and the small pill space may be made to have a basket-like handle that will allow it to be lifted easily.

b. The small pill space may be made to rotate along an axis until it dumps its contents into another space for removal. This is shown in FIGS. 6–8.

c. The small pill space may be made to have a hinge and rotate along the hinge until it dumps its contents into another space for removal. This is shown in FIGS. 9, 10 and 13.

d. The small pill space may be made to be lifted from its place by the use of hands or a lever system. This is shown in FIGS. 5. Or it may allow its contents to be dumped into another receiving space; this method is shown in FIG. 9 and 10.

e. The lever system for the removal of these small pill spaces may be made to be automatic so that the patient could press a button. The button will activate a powered lever system in order to release the pills. This is not shown in pictures.

The motion of this unit and its mechanics.

This unit may be rotated by the following means.

1. The unit may be made to be rotated manually so that the user will hold a piece or handle of the rotating part and turn it so that the pill area will stand under the open area of the cover for removal.

2. The unit may rotated by the use of mechanical means and spring-powered clocks. Thus, it will rotate with a constant speed or intermittently and bring the small pill space under the open area of the cover.

3. Most commonly, the unit will be made to rotate by the use of an electrical engine that will turn the rotating power either continuously or intermittently in order to bring the small pill space under the open area of the cover. The rotation or function of this engine will be adjusted by a computer program which will be able to change many aspects of the movement. The pattern of such a motion may be continuous or intermittent. Any other possible options that a computer program may do may be chosen as well.

4. The plan of rotation may be made electrical as well so that the use of certain simplified buttons will allow the motion of the unit to be controlled.

The cover and some of its specifics.

The cover of this unit may be made from a rigid material, to have a design to encapsulate the unit and protect it from outside actions, the unit will have the following specifics and characteristics.

I. The cover of the unit may have an opening in the top to allow the pills to be removed. The size and shape of such an opening may vary. Also this opening may extend to the side of the cover as well.

II. The opening may be on the side of the cover.

III. The opening for emptying the small pill space may be located in the top and side of the cover in order to allow the small space to be tilted to dispense its contents into an adjacent container that is designed to accept the pills. One example of this unit is shown in FIG. 10. In this model the small pill space is hinged to the outer border of the moving round central piece at "H". This will allow the small snap shown at "S" from the body of the small pill space to be held and the pill space to be rotated to dump the medication into an adjacent space that is designed to receive the medications.

IV. The cover may have units, pieces or methods such as levers and similar means for lifting or removing the pill spaces or medication.

V. The cover may support some ancillary pieces such as lighting, alarm units or any other similar means for the proper functioning of the whole unit.

VI. The cover may support the use of educational materials such as prints, color specifications, directions, etc.

VII. The cover may support some ancillary pieces such as "The pill sample illustrator" which is a piece that will allow the samples of the pills to be seen as well as their nature and directions. This unit may also have a space for placing a picture of a loved one. This piece will be connected to the top of the cover by a means that will allow it to be removed or tilted to stand flat for packaging purposes.

The computer programmer and the functions that it will perform.

The availability of advanced computer chips and mini-computers has made the use of decision making programs possible and popular. This kind of mini computer will be also utilized in these units in order to allow many options to be included in the control of these units and many functions to be done. Such a mini-computer will be utilized in order to allow the speed, timing of rotation or motion of this unit to be changed. The time lapse (allows the period of time that the pill space is open to the user) can be controlled as well. This program will be made to allow such important factors to be chosen and changed at will, etc. The computer may be used to inform the user about the presence of the pills and will be used to sound an alarm, voice or even to activate a telephone line if there was a need for it. The computer programming will be used in its full capacity in order to allow this unit to function best and provide any possible useful options.

How the announcer may function.

The announcer may be used to announce any desired pre-recorded massages for the user. This may be a digital unit activated by the computer. It may say, for example: "Hi, Mom. How are you? Come and pick up your noon pills. Do not forget to drink water after these pills and you are not to have milk with this antibiotic. Remember the doctor said to stop the antibiotic if you developed diarrhea" This method will allow a rather unlimited sort of information to be recorded for the patient's benefit. It may ring a noise or alarm, it may turn on a light or initiate any other suitable alarm signal, etc.

Methods of recognizing if the pills were not taken.

This may be done in many ways; in one method a photocell will be used to check the presence of medication in the small pill space that has passed the open area for removal. The small pill spaces will be chosen to be transparent to allow the light waves to pass. If the container is not empty, the pills will not allow the light to go through and this will cause a signal to act. In this model the sensor may be placed on the top or bottom of the body of the unit and the light in the opposite position. The following methods will allow the light to go through for identification.

m. In some models the small pill spaces will be removed or tilted for use and this will leave the center of the base open for the light to go through freely. The passage of the light and its reaction in the photocell system will prevent the actions.

n. In models in which the small pill space will not be removed the following mechanism will be used to allow the light to go through for identification.

First, the pill space will be made clear to allow the light to pass through.

Second, the bottom of the pill space will be made to be in the lowest spot in the center so that it will hold even the last pill that is not removed. This pill will block the light from going through and will activate the alarm.

Third, the magnified lenses may be used properly to allow the light beam to be directed more effectively for this purpose.

o. Importantly, the unit may be designed so that when the pills are taken by hand and the pill space is moved, it will automatically move a lever or activate a part in order to inactivate the alarm system until the next pill space comes and the cycle will be repeated. Many such designs may be made to serve this purpose. Importantly, the function of turning a signal on or off depending on the way it is set up as an alarm may be done by turning a switch, rotating a knob, a piece, etc. During the removal or rotation of the small pill space, the person can also turn the signal means off and prevent the outgoing signal from being sent.

The method of informing a patient or supervisor from the lack of taking the pills on a timely basis will be done by the use of an alarm system. However, in some cases, especially in elderlies or patients with memory problems, there is a need to know if the person has missed his or her medication. Many times, the supervisors or relatives are not physically present in the area, therefore there is a need for a system to notice the event. For this purpose, the telephone lines will be used and this unit will have a connection line to a telephone line so that if the medication was not taken, the computer or an electrical system will activate a call and when the telephone answers, the computer will signal the supervisor that the pills was not taken. The pill spaces or the computer program will allow the supervisor to know which medication was not removed. The advance of computer technology will allow the supervisor to make choices and to order certain actions in the computer of the unit or to leave messages, etc., in these computers for the best results.

The method of allowing the unused pills to be seen.

The cover of this unit will be made clear to allow the pill spaces to be seen in order to recognize which medication was not removed. This will add significantly to the safety of this unit.

The use of color coding.

The use of color codes will be done in order to allow many important points to be shown in as simple terms as possible. The prototype model of this unit will have 28 spaces and is based on calculations of a maximum of 4 doses of medication per day: the morning, noon, afternoon and evening. This will allow the setting for the medication of one week ahead of time so that the person can have peace of mind for one week, and in the case of elderlies their relatives can put the medication from one day a week to another day of the next week. In this set the group of pill spaces or their adjacent areas may be color coded to allow an easy identification. For example, the area of the spaces for the morning doses may be marked blue, the noon doses at pink, the afternoon dose at yellow and the evening dose in green. This color coding will make seven blue colored areas, seven pink colored areas and seven of the other colors as well so that each one can be identified easily. Then the day of the week or its abbreviation will be marked in each group; for example, the morning dose will have the mark for Monday. The noon, afternoon and evening doses of the same groups all will have a Monday mark to differentiate them from Tuesday's medication and Wednesday's, etc. This will make the identifications of the unused pills easy as well. Again, the upper part of the cover or its side as well will be made clear to allow the pills, coloring and markings to be seen. A single or series of magnifying lenses may facilitate the process.

The method of depositing the pills in pill spaces.

In order to have this important job done on a timely basis. A special unit, which matches the size of the unit and has a series of funnels will be used in order to allow the pills to be easily dumped in the spaces. One such model is shown at FIG. 14 & 15. This will consist of a unit that was previously introduced in the application of "Automatic pill dispenser". This unit will be designed in order to allow it to be easily placed on the pill spaces and will have seven funnels to allow each pill to be dropped into the pill spaces. This piece will be situated on the top of the round piece easily.

The method of putting the small pill spaces.

In the models in which the pill spaces are to be removed, an extra flat space which has an opening 28 or cradle on it will be used. This will be the exact copy of the flat unit on the machine, to allow the pill spaces to be placed on it and finally to be ready to accept the pills for the next round of use. These units will be removed from the whole unit easily and placed on them easily as well. At the end of the week the used piece will be moved out from the machine and this piece will be placed in it to rotate.

Please notice that in practice many of these options and models that are shown will be incorporated in one model in order to allow the best model to be shown, and the main reason that this applicant has not placed all the options into one figure is to prevent overcrowding.

Importantly the size, shape, thickness, length, width, depth, curves, color, consistency and other important characteristics of these units and its components may vary in order to allow different models to be made.

Importantly, the applicant considers that these models may be modified in order to allow many similar models to be made easily.

I claim:

1. An automatic pill dispenser comprising:

a succession of pill supply bins for containing supplies of pills;

moving means for moving said succession of pill supply bins to a dispensing station according to a schedule;

said dispensing station comprising means providing for the contents of each pill supply bin which has arrived at the dispensing station to be dispensed during a corresponding time during which the contents of the bin at the station; and wherein said bins are pivotally mounted on a carrier that is turned by said moving means to sequentially move said bins to the dispensing station, and including a manual actuator that is manually operated to cause a bin at the dispensing station to be pivoted and dispense its contents.

2. An automatic pill dispenser as set forth in claim 1 wherein said bins are open at the top to allow them to be filled, and each contains a funnel-shaped opening at the side via which the contents are dispensed when pivoted on the carrier at the dispensing station.

3. An automatic pill dispenser as set forth in claim 1 wherein said manual actuator comprises a manual lifting tab that is manually lifted to pivot the bin at the dispensing station.

4. An automatic pill dispenser as set forth in claim 3 wherein each of said bins comprises its own manual lifting tab.

5. An automatic pill dispenser as set forth in claim 4 wherein said manual actuator comprises a manually actuated lever mechanism that is disposed at the dispensing station, and that when actuated, operates to pivot the bin at the dispensing station.

6. An automatic pill dispenser as set forth in claim 1 wherein a cover is disposed in covering relation to said succession of pill supply bins, and said dispensing station comprising an opening in said cover via which the contents of a pill supply bin are dispensed, and a clear band allowing pill supply bins not at the dispensing station to be seen.

7. An automatic pill dispenser as set forth in claim 6 wherein said cover includes medical indicia for enabling a reader to identify the contents of the pill supply bins, the medical indicia being in the form of a chart containing a pictorial representation of various medicines dispensed by the dispenser and a verbal identification of the respective medicine.

8. An automatic pill dispenser comprising:

a succession of pill supply bins for containing supplies of pills;

moving means for moving said succession of pill supply bins to a dispensing station according to a schedule;

said dispensing station comprising means providing for the contents of each pill supply bin which has arrived at the dispensing station to be dispensed during a corresponding time during which the contents of the bin at the station; and wherein said bins are mounted on a carrier that is turned by said moving means to sequentially move said bins to the dispensing station, and including a manual actuator at the dispensing station that is manually operated to bodily move a bin relative to the carrier at the dispensing station to dispense its contents.

9. An automatic pill dispenser as set forth in claim 8 wherein said manual actuator comprises a manually actuated lever mechanism disposed at the dispensing station.

10. An automatic pill dispenser as set forth in claim 9 wherein when said lever mechanism is actuated, it pivots the bin at the dispensing station relative to the carrier to cause the bin's contents to be dispensed by gravity.

11. An automatic pill dispenser as set forth in claim 9 wherein when said lever mechanism is actuated, it bodily lifts the bin at the dispensing station from the carrier to dispense that bin's contents by making them manually accessible.

12. An automatic pill dispenser as set forth in claim 8 wherein a cover is disposed in covering relation to said succession of pill supply bins, and said dispensing station comprising an opening in said cover via which the contents of a pill supply bin are dispensed, and a clear band allowing pill supply bins not at the dispensing station to be seen.

13. An automatic pill dispenser as set forth in claim 12 wherein said cover includes medical indicia for enabling a reader to identify the contents of the pill supply bins, the medical indicia being in the form of a chart containing a pictorial representation of various medicines dispensed by the dispenser and a verbal identification of the respective medicine.

14. An automatic pill dispenser comprising:

a succession of pill supply bins for containing supplies of pills;

moving means for moving said succession of pill supply bins to a dispensing station according to a schedule;

said dispensing station comprising means providing for the contents of each pill supply bin which has arrived at the dispensing station to be dispensed during a corresponding time during which the contents of the bin at the station; and a cover disposed in covering relation to said succession of pill supply bins, and including medical indicia for enabling a reader to identify the contents of the pill supply bins, wherein the medical indicia is in the form of a chart containing a pictorial representation of various medicines dispensed by the dispenser and a verbal identification of the respective medicine.

15. An automatic pill dispenser as set forth in 14 wherein the top of the cover contains an upright mounting for the chart so that the chart is uprightly displayed, and this upright mounting contains space for upright placement of sheet material thereon.

16. An automatic pill dispenser comprising:

a succession of pill supply bins for containing supplies of pills;

moving means for moving said succession of pill supply bins to a dispensing station according to a schedule;

said dispensing station comprising means providing for the contents of each pill supply bin which has arrived at the dispensing station to be dispensed during a corresponding time during which the contents of the bin at the station; and wherein each of said bins comprises a bottom wall having a depression for containing any contents that remain at the bin has left the dispensing station.

17. An automatic pill dispenser as set forth in 16 further including sensing and signaling means for sensing any contents in the depression in the bottom wall of each bin after it has departed the dispensing station and signaling whether any contents remain in the depression.

18. An automatic pill dispenser as set forth in claim 16 wherein said pill supply bins have top openings for filling them and they are transparent to radiant energy at least at their bottom wall depressions, said sensing and signaling means comprises a radiant energy source and a radiant energy detector arranged such that the bottom wall depression of a departed bin passes between them.

19. An automatic pill dispenser as set forth in claim 18 wherein said radiant energy source and said radiant energy detector are arranged in vertical alignment.

20. An automatic pill dispenser as set forth in claim 16 wherein said bins are pivotally mounted on a carrier that is turned by said moving means to sequentially move said bins to the dispensing station, said bins are open at the top to allow them to be filled, and each bin contains a funnel-shaped opening at the side via which the contents are dispensed when pivoted on the carrier at the dispensing station.

* * * * *